US007066563B2

(12) United States Patent
Berger

(10) Patent No.: US 7,066,563 B2
(45) Date of Patent: Jun. 27, 2006

(54) EXPANDABLE DRAWER ORGANIZER

(75) Inventor: Andrew L. Berger, Des Plaines, IL (US)

(73) Assignee: Axis International Marketing, Ltd., Des Plaines, IL (US)

( * ) Notice: Subject to any disclaimer, the term of this patent is extended or adjusted under 35 U.S.C. 154(b) by 220 days.

(21) Appl. No.: 10/641,482

(22) Filed: Aug. 16, 2003

(65) Prior Publication Data

US 2004/0155564 A1 Aug. 12, 2004

Related U.S. Application Data

(60) Provisional application No. 60/446,196, filed on Feb. 10, 2003.

(51) Int. Cl.
*A47B 88/00* (2006.01)

(52) U.S. Cl. ..... 312/348.3; 312/205

(58) Field of Classification Search ..... 312/348.3, 312/205, 291, 301; 220/544, 534, 529, 551, 220/8, 485, 486, 491, 492
See application file for complete search history.

(56) References Cited

U.S. PATENT DOCUMENTS

| | | | | | |
|---|---|---|---|---|---|
| 958,857 | A * | 5/1910 | Dennis | 220/8 |
| 2,148,681 | A * | 2/1939 | Cameron | 220/551 |
| 2,218,300 | A * | 10/1940 | Schuster | 220/8 |
| 2,504,466 | A * | 4/1950 | Stolzoff | 211/11 |
| 2,889,924 | A * | 6/1959 | Paulucci | 206/561 |
| 3,003,840 | A * | 10/1961 | Katzin | 312/298 |
| 3,145,850 | A * | 8/1964 | Ciborowski | 211/133.5 |
| 3,244,288 | A * | 4/1966 | Schreter | 211/74 |
| 3,501,020 | A * | 3/1970 | George | 211/184 |
| 3,866,788 | A * | 2/1975 | Smit | 220/486 |
| 4,036,369 | A | 7/1977 | Eisenberg | |
| 4,889,253 | A * | 12/1989 | Schmulian et al. | 220/551 |
| 4,909,406 | A * | 3/1990 | Wu | 220/8 |
| 4,982,857 | A * | 1/1991 | Sher | 220/4.03 |
| 5,016,772 | A * | 5/1991 | Wilk | 220/8 |
| 5,031,769 | A * | 7/1991 | Shea et al. | 206/335 |
| 5,384,937 | A * | 1/1995 | Simon | 24/295 |
| 5,738,425 | A * | 4/1998 | Rosenberg et al. | 312/348.3 |
| 5,803,276 | A * | 9/1998 | Vogler | 211/184 |
| 6,279,467 | B1 | 8/2001 | Tiemann | |
| 6,341,704 | B1 * | 1/2002 | Michel, Jr. | 211/181.1 |
| 6,457,594 | B1 | 10/2002 | Tiemann | |
| 6,685,037 | B1 * | 2/2004 | Zadak | 211/184 |
| 6,691,884 | B1 * | 2/2004 | Dwyer | 220/4.03 |
| 2004/0004420 | A1 * | 1/2004 | Pine et al. | 312/348.3 |
| 2004/0245254 | A1 * | 12/2004 | Rosenberg et al. | 220/507 |

* cited by examiner

*Primary Examiner*—Janet M. Wilkens
(74) *Attorney, Agent, or Firm*—Barnes & Thornburg LLP

(57) ABSTRACT

Embodiments of an expandable drawer organizer for segregating articles within a drawer are disclosed. Each embodiment utilizes at least one tray maintained in slidable agreement with another a tray, providing for the expandable drawer organizer to be varied to approximate the dimensional constraints of the subject drawer. Each embodiment further employs a locking mechanism for securing the associated trays in a user dictated predetermined position. Additional embodiments utilizing various arrangements of an expandable partition that may be arranged in unique configurations within the various trays is also disclosed. Several embodiments having retainers for further limiting the movement of the expandable drawer organizer within the drawer are also presented.

15 Claims, 7 Drawing Sheets

EXPANDABLE DRAWER ORGANIZER

CLAIM FOR PRIORITY OF INVENTION

This application claims the benefit of U.S. Provisional Application No. 60/446,196, Expandable Drawer Organizer, filed 10 Feb. 2003 presently co-pending in accordance with 35 USC § 119 (e).

BACKGROUND OF THE INVENTION

1. Field of the Invention

The present invention specifically relates to an expandable drawer organizer for accommodating drawers of various sizes and a method for the organization of various articles within a drawer.

2. Description of the Related Art

The efficient organization of various articles within a drawer, whether they are tools, cutlery, hardware, toiletries or other sundry items, has long presented a problem for the users of such items. One such attempt to address the problem has been by the use of boxes positioned within the drawer. However, an inherent shortcoming of this approach is the need to arrange individual boxes into a specific arrangement tailored exclusively to the drawer or other like drawers having the same dimensional configuration. Another drawback is that the boxes may not effectively utilize the drawer area, resulting in an underutilization of the drawer storage capacity, due to the ill fit of the boxes. The use of boxes also raises a durability concern for the user, especially when heavy, bulky or sharp items are concerned which, require that the user frequently replace, repair or discard the damaged boxes. Yet, another issue that this approach fails to address is that of portability; as the boxes are limited to the present configuration within drawers having similar dimensional constraints thereby creating further issues of underutilization based on the drawer area and individual box dimensions. Even if this particular limitation can be overcome, the user is subsequently presented with the time consuming and burdensome task of disassembly and reassembly of the configuration within the new location. It would be advantageous to have an organizer that overcomes the issues presented by this approach.

Another approach is the use of separators, which span either the width, or length of a drawer, which may be of either non-adjustable permanent-type, adjustable permanent-type or temporary construction. These each suffer the inherent difficulty of being specific to the drawer where they are employed and typically lack interchangeability among drawers having different dimensional configurations, this point is most pronounced with the permanently affixed and adjustable permanent-type separators. Often, these approaches require that the drawer be customized to accommodate the separators and prevent the movement or collapse of the separator when the drawer is opened or closed, especially when containing heavy articles, i.e. tools, hardware, dishes, etc. This solution in the case of adjustable permanent-type and temporary separators, like the use of the boxes before, require the user to carefully configure the arrangement of the separators to form spaces that are specific to the article(s) in question, in order to assure optimum utilization of the drawer area. In the case of the non-adjustable permanent-type separators, the user must given careful consideration to the materials to be organized in the drawer, as future modifications imposes the need to remanufacture the drawer to accommodate the new arrangement. Both non-adjustable and adjustable permanent-type separators force the user to incur the increased cost of custom drawers and related components necessary to facilitate the use these separators. In attempts to address the issue of cost concerns native to the non-adjustable and adjustable permanent-type separators; temporary separators have been introduced which, are constructed of less durable materials that often lack the structural integrity required to retain heavy articles without the separator sustaining damage. The user of such temporary separators is often faced with the repeated replacement of the separator over the lifetime of the drawer. Lastly, the use of both permanent-type and temporary separators present an impediment to cleaning the drawer base, as the individual articles must be removed to allow for cleaning the interior drawer surfaces. A device for organization of articles within a drawer that addresses the failings of this approach would be most desirable.

In an endeavor to surmount the inadequacies posed by the previous attempts to compartmentalize drawers by use of either boxes or separators, the use of expanding trays as typified by U.S. Pat. No. 5,738,425, Adjustable Drawer Organizer, has been developed. Although, this device appears to remedy the aforementioned list of deficiencies presented by its precursors, there are a number of distinct new limitations that are imposed upon the user. The first being, that the configuration of these trays is fixed and inflexible, as the tray compartments cannot be rearranged to suit an individual user preference. This issue is further compounded when the expandable organizer is expanded, in such an instance the user is presented with one tray section comprising permanently affixed separators, which establish rigid constraints regarding the compartmentalization of the section, and at least one open tray section wholly devoid of any partition for optimizing the arrangement of articles in the section. This problem requires that boxes must be employed in concert with the expandable organizer to achieve an acceptable means of segregating articles within the open section(s) of the organizer. Attempts to utilize separators in the open section(s) of the organizer fail to generate configurations other than elongated compartments, which may vary from narrow to broad in width. Further efforts to customize the compartments require the user to fashion components specific to the compartment width and secure these to the tray section or separator. The resulting arrangement is a regression to the permanent-type separator approach that is specific for the drawer in question. Another significant issue regarding the drawer organizer is retaining the position of the organizer within a drawer, given a drawer of length greater than the organizer and articles of notable mass. The typical approach has been to affix feet constructed of non-slip material to the bottom of the organizer, and to rely upon gravity and friction to secure the position of the organizer within the drawer. However, when the organizer contains articles of notable mass and the drawer is opened with sufficient force, so as to impart momentum to its contents, the organizer may be slammed to the rear of the drawer and the contents may be disrupted. A device for organization of articles within a drawer that could eliminate these concerns would be of great advantage to a user.

It would be most desirable to a user to have an organizer, which overcomes the collective disadvantages posed by each of the above approaches in the storage of articles in a drawer.

SUMMARY OF THE INVENTION

The present invention, an expandable drawer organizer relates to an apparatus for segregating articles within drawers, having differing dimensional parameters. Various aspects of the invention are novel, non-obvious, and provide various advantages. While the actual nature of the present invention covered herein can only be determined with reference to the claims appended hereto, certain features, which are characteristic of the embodiments disclosed herein, are described briefly as follows.

A first aspect of the invention provides an expandable drawer tray for segregating articles in a drawer, wherein a base tray having at least one recess in one of either the front and rear side panel is slidably connected to a first nesting tray having a corresponding protuberance in one of either the front and rear side panel; wherein the base tray and first nesting tray are expanded to a predetermined length in a drawer and maintained in relative position by an locking mechanism. This aspect is largely repeated in another embodiment of the invention having a base tray, first and second nesting tray, slidably connected with a similar locking mechanism for securing the trays at a predetermined length within a drawer. This aspect permits a user to optimize the use of the drawer space constraints without being limited to a set drawer dimensions, thus providing for interchangeability of the expandable drawer organizer and overcoming the previously mentioned portability limitations.

A second aspect of the invention provides for a detachably connected expandable partition that is extended to a predetermined length and therein secured by a locking mechanism, wherein the expandable partition may be arranged in a number of unique user defined arrangements. This aspect directly overcomes the previous need for a customized drawer tray configuration, while simultaneously maintaining the desired interchangeability of the organizer between drawers of differing dimensional constraints.

A third aspect of the invention provides for a detachably connected first and second extendable retainer that is extended to a predetermined length, wherein the extendible retainer secures the position of the expandable drawer organizer within the drawer. Another embodiment of this aspect utilizes an expandable partition in conjunction with the extendable retainer, to provide optimization of the drawer area. This aspect of the invention serves to address the issues of the organizer shifting within the drawer and the utilization of drawer area beyond that covered by the expandable drawer organizer.

DETAILED DESCRIPTION OF THE PRESENTLY PREFERRED EMBODIMENTS

FIGS. 1–11 illustrate various embodiments of an expandable drawer organizer in accordance with the present invention.

Figure 1:
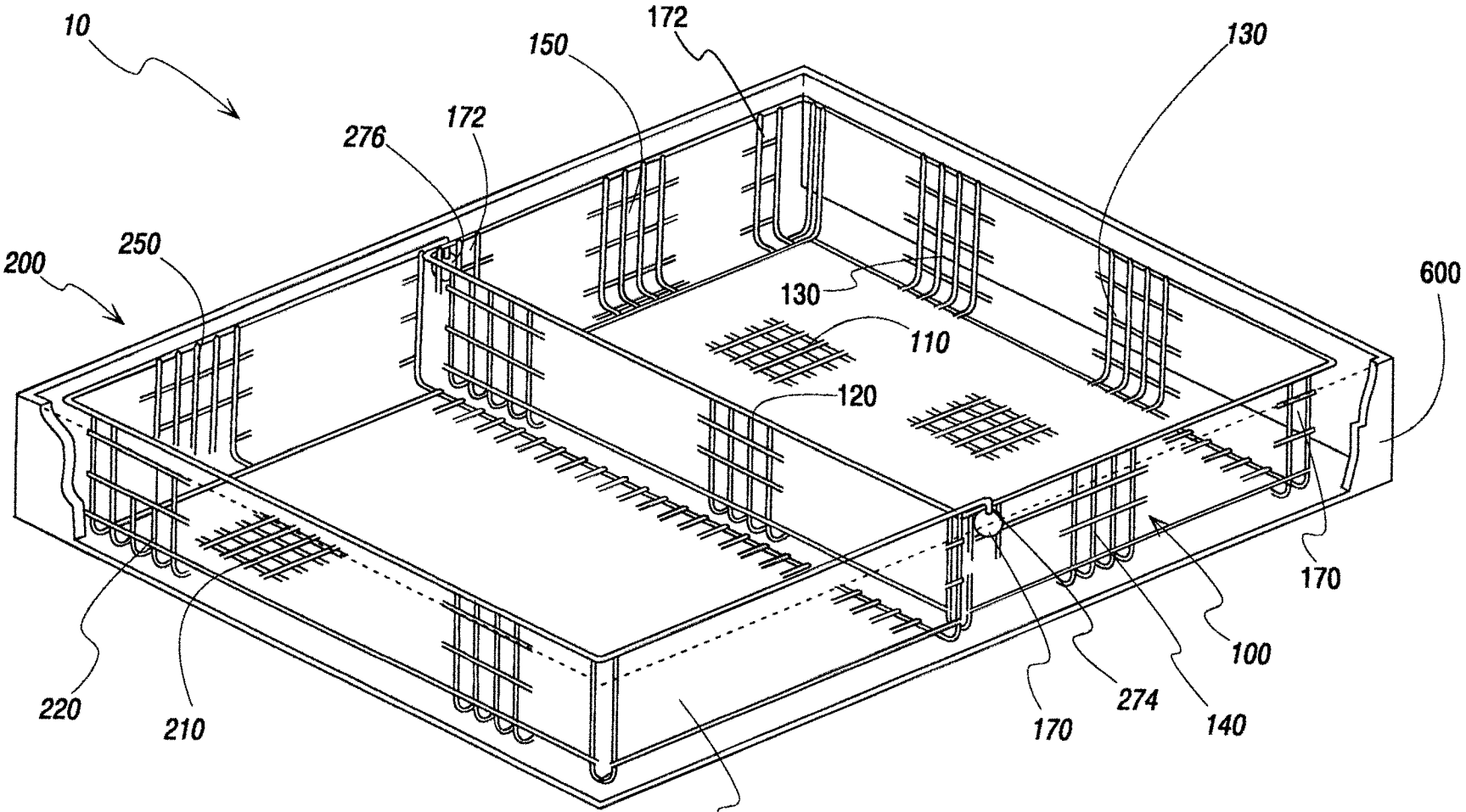
FIG. 1 is a drawing showing a perspective view of an assembled two tray expandable drawer organizer, having a base tray and a first nesting tray, in accordance with the present invention.

Referring to FIG. 1 one embodiment of a two tray expandable drawer organizer is generally shown at number 10. The expandable drawer organizer 10 of the present invention generally comprises a base tray 100 and a first nesting tray 200. The base tray 100 may have a given length and width to allow it to be slidably received by the first nesting tray 200. This arrangement serves to permit the expandable drawer organizer 10 to accommodate drawers of varying dimensional characteristics permitting a user to optimize the utilization of drawer space without compromising flexibility. The base tray 100 and a first nesting tray 200 may be set at a predetermined length wherein a locking mechanism 50 (FIG. 4–6) comprised of an engagement of the front panel protuberance 274 (FIG. 6) and rear panel protuberance 276 (FIG. 6) with the corresponding front panel recess in 170 (FIG. 6) and rear panel recess 172 (FIG. 6) is generally formed, which may serve to secure the expandable drawer tray 10 position within the drawer 600.

Figure 2:
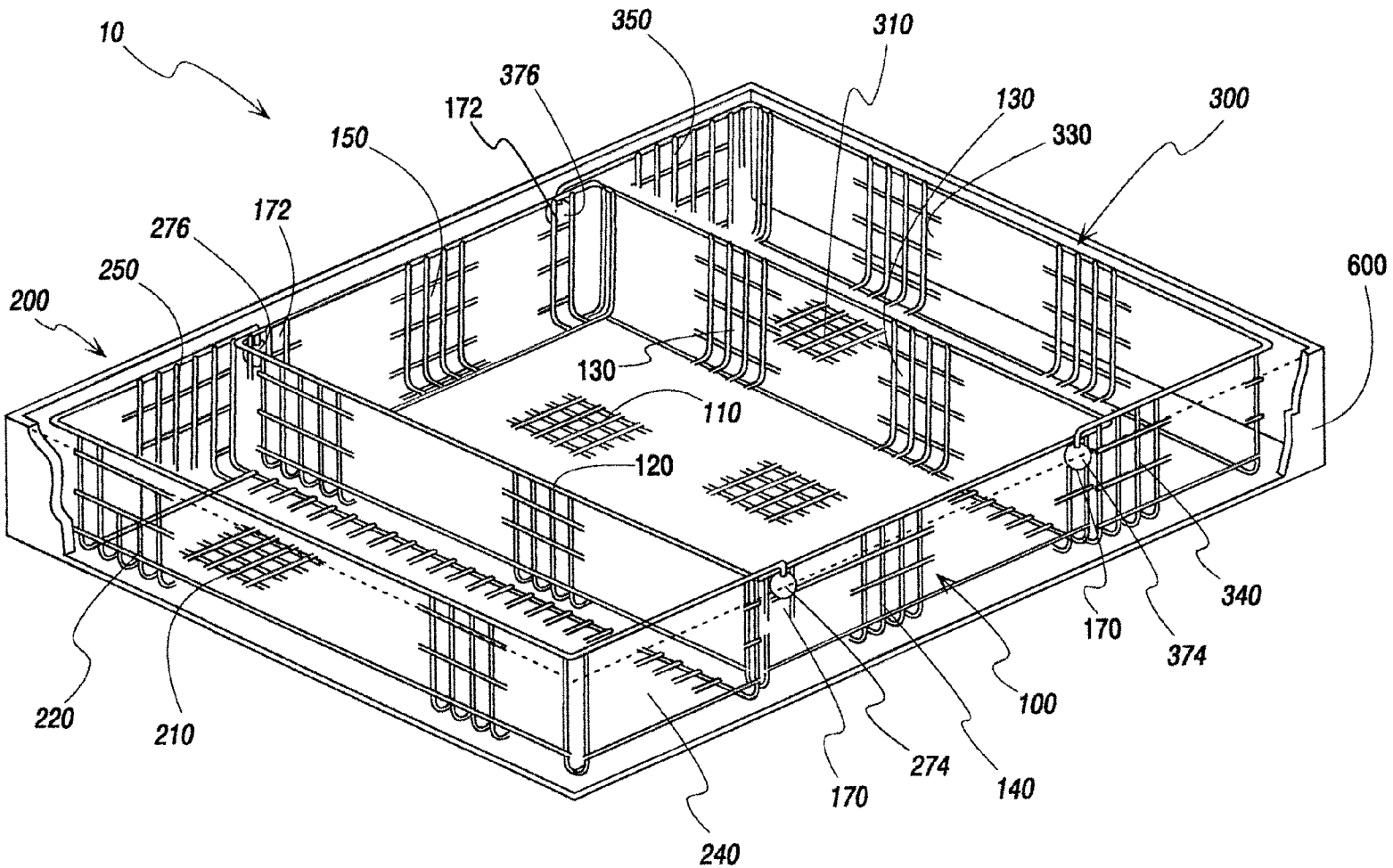
FIG. 2 is a drawing showing a perspective view of an assembled three tray expandable drawer organizer, having a base tray, a first nesting tray and a second nesting tray, in accordance with the present invention.
Figure 3:
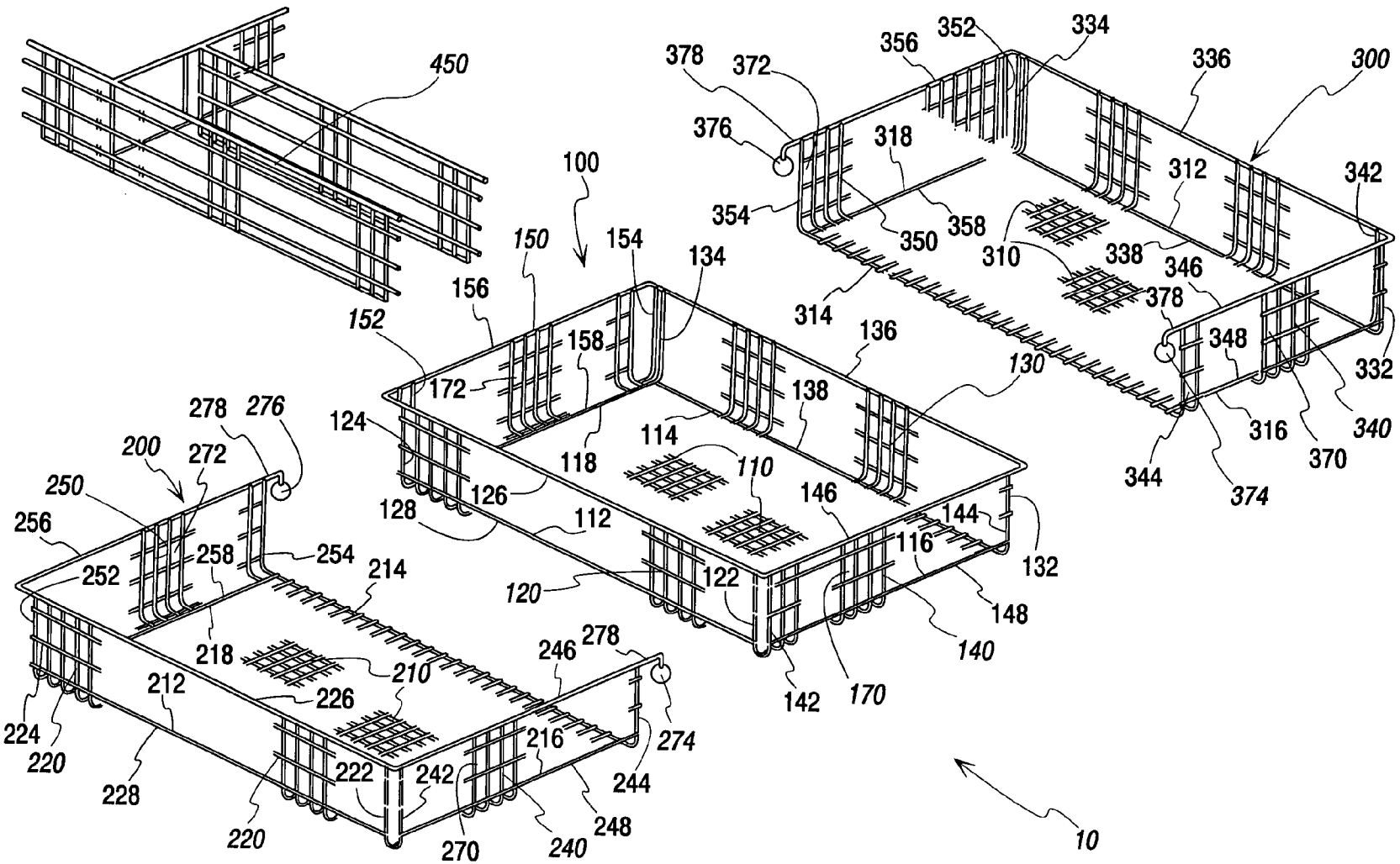
FIG. 3 is a drawing showing a perspective view of an unassembled three tray expandable drawer organizer, having a base tray, a first nesting tray and a second nesting tray, in accordance with the present invention.

Referring to FIGS. 2 and 3 one embodiment of a three tray expandable drawer organizer of the present invention is generally shown at number 10. The expandable drawer organizer 10 of the present invention generally comprises a base tray 100, a first nesting tray 200 and a second nesting tray 300. The base tray 100 may have a given length and width to allow it to be slidably received by both the first nesting tray 200 and second nesting tray 300. This arrangement serves to permit the expandable drawer organizer 10 to accommodate drawers of varying dimensional characteristics permitting a user to optimize the utilization of drawer space without compromising flexibility. The base tray 100, first nesting tray 200 and second nesting tray 300 may be set at a predetermined length wherein a locking mechanism 50 (FIG. 4–6) comprised of an engagement of the front panel protuberance 274 (FIG. 6) and rear panel protuberance 276 (FIG. 6) with the corresponding front panel recess in 170 (FIG. 6) and rear panel recess 172 (FIG. 6) is generally formed, a similar arrangement is generally reflected at each of the second nesting tray 300 front panel protuberance 374 and rear panel protuberance 376 with the corresponding front panel recess in 170 and rear panel recess 172; which may serve to secure the expandable drawer tray 10 position within the drawer 600.

Referring to FIGS. 1, 2 and 3 one embodiment of base tray of the expandable drawer organizer 10 is generally shown at number 100. The base tray 100 may compromise a bottom panel 110 having a rectangular shape of a given length and width, a first side panel 120 having a rectangular shape of a given height and a length corresponding to the bottom panel 110, a second side panel 130 having a rectangular shape of a given height and substantially similar length to the first side panel 120, a front side panel 140 having a rectangular shape of a substantially similar height to each of the first side panel 120 and second side panel 130, and length corresponding to the base tray 100, and rear side panel 150 having a rectangular shape of a given height and substantially similar length to the front side panel 140. The first side panel 120 may be adjoined to the bottom panel 110 in a substantially perpendicular manner, wherein the bottom panel first edge 112 (FIG. 3) and the first side panel bottom edge 128 (FIG. 3) are maintained in continuous agreement over their length. The second side panel 130 may be adjoined to the bottom panel 110 in a substantially perpendicular manner, wherein the bottom panel second edge 114 (FIG. 3) and the second side panel bottom edge 138 (FIG. 3) are maintained in continuous agreement over their length, wherein the second side panel 130 may be in parallel alignment to the first side panel 120. The front side panel 140 may be adjoined to the bottom panel 110 in a substantially perpendicular manner, wherein the bottom panel front panel edge 116 (FIG. 3) and the front side panel bottom edge 148 (FIG. 3) are maintained in continuous agreement over their length. The front side panel 140 may also be adjoined to each of the first side panel 120 and second side panel 130 in a substantially perpendicular manner, wherein the front side panel first edge 142 (FIG. 3) and front panel side second edge 144 (FIG. 3) are maintained in continuous agreement over their length with the respective first side panel front edge 122 (FIG. 3) and second side panel front edge 132 (FIG. 3). The rear side panel 150 may be adjoined to the bottom panel 110 in a substantially perpendicular manner, wherein the bottom panel rear edge 118 (FIG. 3) and the rear side panel bottom edge 158 (FIG. 3) are maintained in continuous agreement over their length. The rear side panel 150 may also be adjoined to each of the first side panel 120 and second side panel 130 in a substantially perpendicular manner, wherein the rear side panel first edge 152 (FIG. 3) and rear side panel second edge 154 (FIG. 3) are maintained in continuous agreement over their length with the respective first side panel rear edge 124 (FIG. 3) and second side panel rear edge 134 (FIG. 3). The rear side panel 150 being in substantially parallel alignment with the front side panel 140. The first side panel top edge 126 (FIG. 3), second side panel top edge 136 (FIG. 3), front side panel top edge 146 (FIG. 3) and rear side panel top edge 156 (FIG. 3) may exhibit congruency within a common plane. The base tray 100 may be constructed of wood, metal, plastic or any combination thereof that provide suitable structural properties to accommodate the aforementioned construction and provide the desired rigidity. The method of adjoining each of the aforementioned sides may be by any means know in the Mechanical Arts such as welding, soldering, brazing, the use of fasteners, rivets, screws, nails, or the use of adhesives. The base tray 100 may also be manufactured by such techniques as extrusion, cold forming methods i.e., bending, braking, shearing, cutting or hot forming methods i.e., casting or extrusion or combinations thereof that may yield similar construction. The front side panel 140 and rear side panel 150 of the base tray 100 of the present invention may respectively have at least one front side panel recess 170 (FIG. 3) and rear side panel recess 172 (FIG. 3), that may be arranged in a row in the face of each panel being of a given shape and depth to accommodate the respective first nesting tray 200 front side panel protuberance 274 (FIG. 3) and rear side panel protuberance 276 (FIG. 3) and in the case of the three tray expandable organizer 10 to accommodate the respective second nesting tray 300 front side panel protuberance 374 (FIG. 3) and rear side panel protuberance 376 (FIG. 3). In another embodiment of the base tray 100, the front side panel 140 and rear side panel 150 may respectively have at least one front side panel protuberance and rear side panel protuberance, that may be arranged in a row on the face of each panel being of a given shape and depth to accommodate the respective first nesting tray 200 and second nesting tray 300 front side panel recesses and rear side panel recesses. The base tray 100 may also have partitions 450 (FIG. 3) adjoined in normal position to the bottom panel 110 and at least one side of the base tray 100 to form compartments of a rectangular nature. In another embodiment, the expandable partitions 500 (FIG. 7) and fixed length partitions may be employed which may utilize a locking mechanism based upon the arrangement of protuberances and recesses similar to the arrangement utilized to secure the base tray 100, first nesting tray 200 and second nesting tray 300 at a predetermined length.

Figure 4:
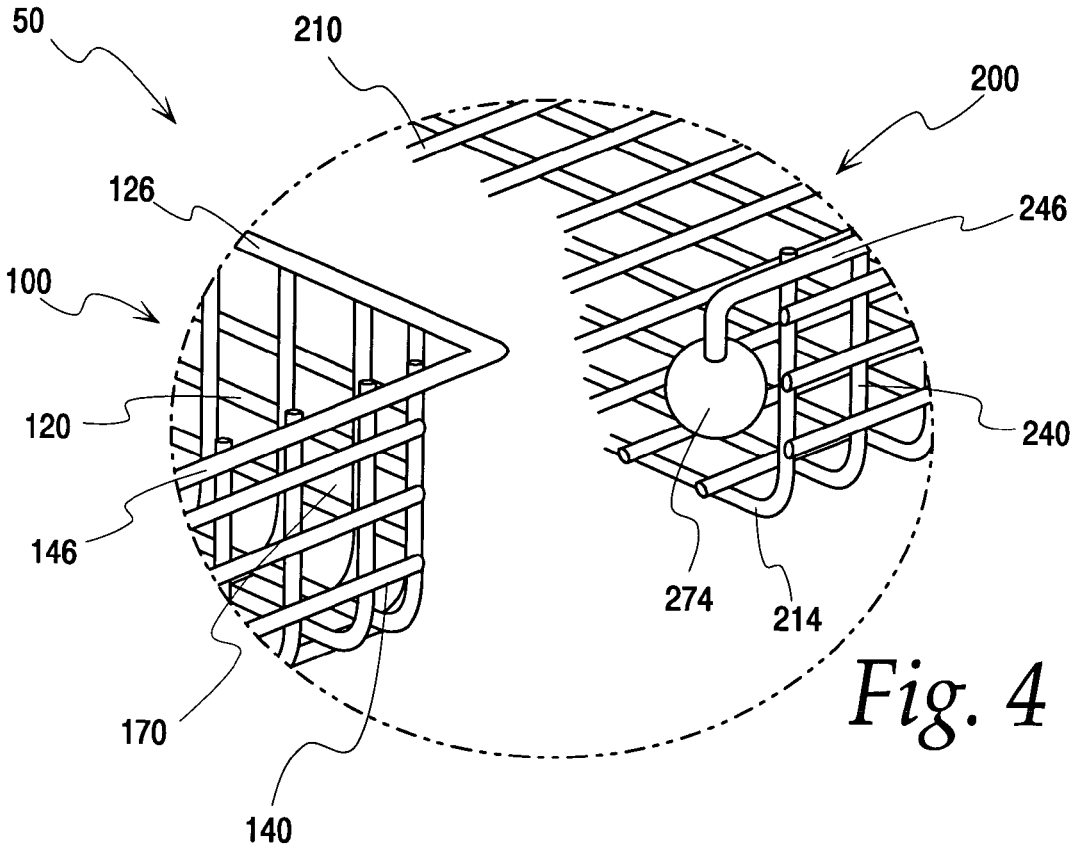
FIG. 4 is a drawing showing a detail in perspective view of the locking mechanism of the base tray and first nesting tray of the expandable drawer organizer prior to engagement, in accordance with the present invention.
Figure 5:
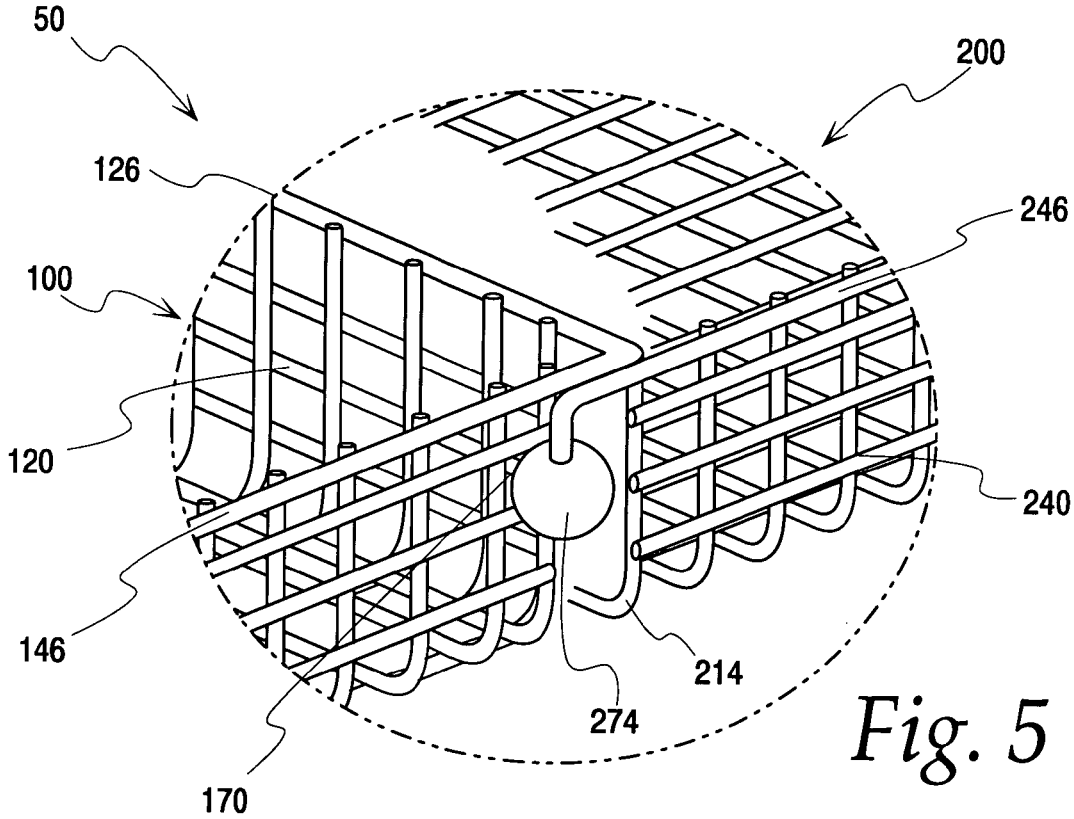
FIG. 5 is a drawing showing a detail in perspective view of the locking mechanism of the base tray and first nesting tray of the expandable drawer organizer after engagement, in accordance with the present invention.
Figure 6:
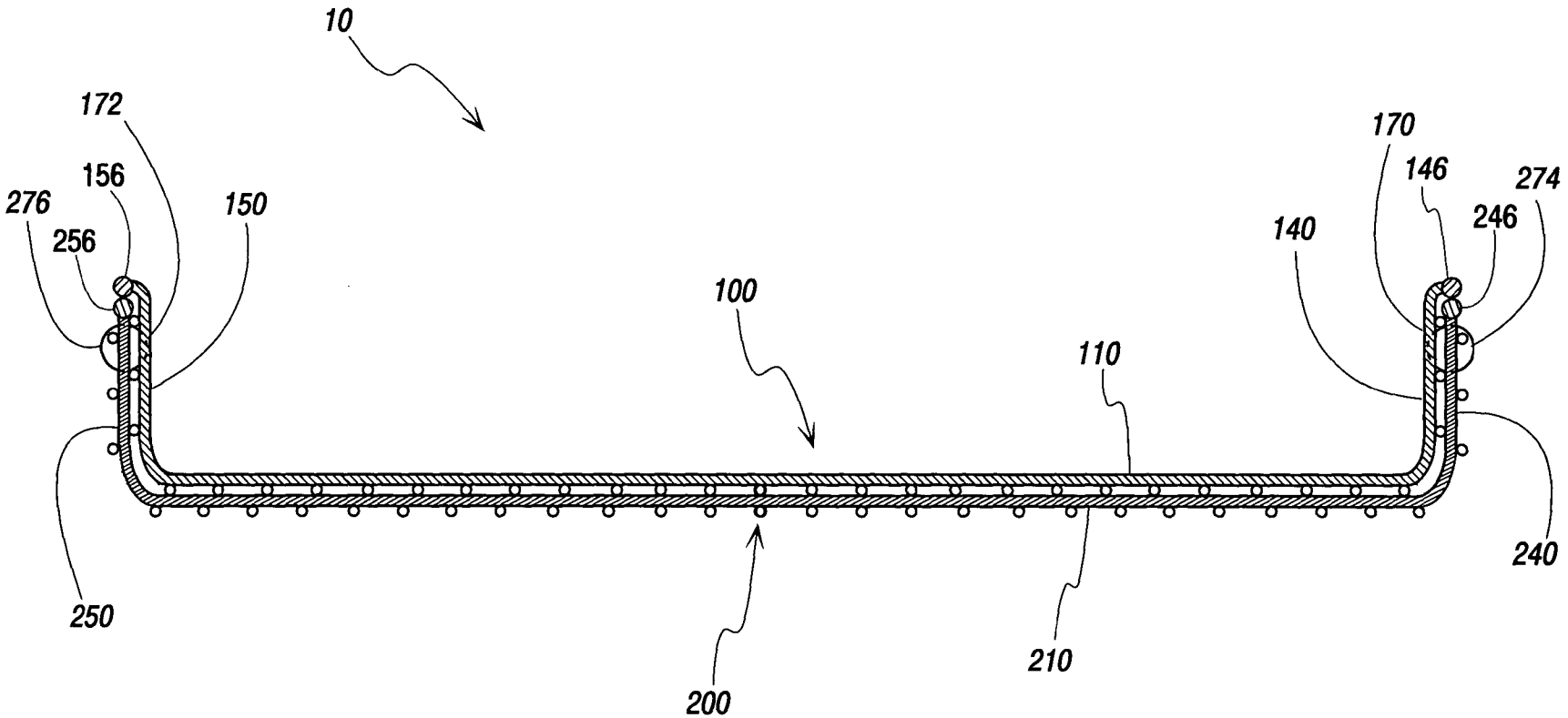
FIG. 6 is a drawing showing a side view of an assembled two tray expandable drawer organizer, showing the base tray and first nesting tray secured by a locking mechanism in accordance with the present invention.

Referring to FIGS. 1, 2 and 3 one embodiment of the first nesting tray is generally shown at number 200. The first nesting tray 200 may compromise a bottom panel 210 having a rectangular shape of a given length and width, a first side panel 220 having a rectangular shape of a given height and a length corresponding to the bottom panel 210, a front side panel 240 having a rectangular shape of a substantially similar height to the first side panel 220, and length corresponding to the first nesting tray 200, and rear side panel 250 having a rectangular shape of a given height and substantially similar length to the front side panel 240. The first side panel 220 may be adjoined to the bottom panel 210 in a substantially perpendicular manner, wherein the bottom panel first edge 212 (FIG. 3) and the first side panel bottom edge 228 (FIG. 3) are maintained in continuous agreement over their length. The front side panel 240 may be adjoined to the bottom panel 210 in a substantially perpendicular manner, wherein the bottom panel front edge 216 (FIG. 3) and the front side panel bottom edge 248 (FIG. 3) are maintained in continuous agreement over their length. The front side panel 240 may also be adjoined to the first side panel 220 in a substantially perpendicular manner, wherein the front side panel first edge 242 (FIG. 3) and the respective first side panel front edge 222 (FIG. 3) are maintained in continuous agreement over their length. The rear side panel 250 may be adjoined to the bottom panel 210 in a substantially perpendicular manner, wherein the bottom panel rear edge 218 (FIG. 3) and the rear side panel bottom edge 258 (FIG. 3) are maintained in continuous agreement over their length. The rear side panel 250 may also be adjoined to the first side panel 220 in a substantially perpendicular manner, wherein the rear side panel first edge 252 (FIG. 3) and respective first side panel rear edge 224 (FIG. 3) are maintained in continuous agreement over their length. The rear side panel 250 being in substantially parallel alignment with the front side panel 240. The first side panel top edge 226 (FIG. 3), front side panel top edge 246 (FIG. 3) and rear side panel top edge 256 (FIG. 3) may exhibit congruency within a common plane. The bottom panel second edge 214 (FIG. 3) is adjoined to the front side panel second edge 244 (FIG. 3) and rear side panel second edge 254 (FIG. 3) in a substantially perpendicular manner to form an opening to receive the base tray 100. The first nesting tray 200 may be constructed of wood, metal, plastic or any combination thereof that provide suitable structural properties to accommodate the aforementioned construction and provide the desired rigidity. The method of adjoining each of the aforementioned sides may be by any means know in the Mechanical Arts such as welding, soldering, brazing, the use of fasteners, rivets, screws, nails, or the use of adhesives. The first nesting tray 200 may also be manufactured by such techniques as extrusion, cold forming methods i.e., bending, braking, shearing, cutting or hot forming methods i.e., casting or extrusion or combinations thereof that may yield similar construction. The front side panel 240 and rear side panel 250 of the first nesting tray 200 of the present invention may respectively have at least one front side panel protuberance 274 (FIG. 3) and rear side panel protuberance 276 (FIG. 3), each being attached to a protuberance support 278 (FIG. 3) which extends from the front side panel top edge 246 (FIG. 3) and rear side panel top edge 256 (FIG. 3) respectively. The front side panel protuberance 274 (FIG. 3) and rear side panel protuberance 276 (FIG. 3) each forming a head at the proximal end of the protuberance support 278 (FIG. 3). The protuberance head being of a given solid shape having substantial dimensional compliance to be securely positioned in the respective base tray 100 front panel recess 170 (FIG. 3) and rear panel recess 172 (FIG. 3). In another embodiment of the first nesting tray 200, the front side panel 240 and rear side panel 250 may respectively have at least one front panel protuberance and rear panel protuberance, that may be arranged in a row on the face of each panel being of a given shape and size to accommodate the respective base tray 100 front side panel recess and rear side panel recess. In another embodiment of the first nesting tray 200, the front side panel 240 and rear side panel 250 may respectively have at least one front side panel recess 270 (FIG. 3) and rear side panel recess 272 (FIG. 3), that may be arranged in a row on the face of each panel being of a given shape and depth to accommodate the respective base tray 100 front side panel protuberance and rear side panel protuberance. Subsequently, the expandable drawer organizer 10 may be set at a predetermined length and accordingly maintained by the locking mechanism 50 (FIG. 4–6). In another embodiment the nesting tray 200 may also have expandable partitions 500 (FIG. 7), fixed length partitions or any combination thereof that may be employed which may utilize a locking mechanism based upon the arrangement of protuberances and recesses similar to the arrangement utilized to secure the base tray 100, first nesting tray 200 and second nesting tray 300 at a predetermined length. The expandable partitions 500 (FIG. 7) may be detachably attached in normal position to the bottom panel 210 and at least one side of the first nesting tray 200 to form one or more compartments of a rectangular nature.

Referring to FIGS. 2 and 3 one embodiment of the second nesting tray is generally shown at number 300. The second nesting tray 300 may compromise a bottom panel 310 having a rectangular shape of a given length and width, a first side panel 330 having a rectangular shape of a given height and a length corresponding to the bottom panel 310, a front side panel 340 having a rectangular shape of a substantially similar height to the first side panel 330, and length corresponding to the second nesting tray 300, and rear side panel 350 having a rectangular shape of a given height and substantially similar length to the front side panel 340. The first side panel 330 may be adjoined to the bottom panel 310 in a substantially perpendicular manner, wherein the bottom panel first edge 312 (FIG. 3) and the first side panel bottom edge 338 (FIG. 3) are maintained in continuous agreement over their length. The front side panel 340 may be adjoined to the bottom panel 310 in a substantially perpendicular manner, wherein the bottom panel front edge 316 (FIG. 3) and the front side panel bottom edge 348 (FIG. 3) are maintained in continuous agreement over their length. The front side panel 340 may also be adjoined to the first side panel 330 in a substantially perpendicular manner, wherein the front side panel first edge 342 (FIG. 3) and the respective first side panel front edge 332 (FIG. 3) are maintained in continuous agreement over their length. The rear side panel 350 may be adjoined to the bottom panel 310 in a substantially perpendicular manner, wherein the bottom panel rear edge 318 (FIG. 3) and the rear side panel bottom edge 358 (FIG. 3) are maintained in continuous agreement over their length. The rear side panel 350 may also be adjoined to the first side panel 330 in a substantially perpendicular manner, wherein the rear side panel first edge 352 (FIG. 3) and respective first side panel rear edge 334 (FIG. 3) are maintained in continuous agreement over their length. The rear side panel 350 being in substantially parallel alignment with the front side panel 340. The first side panel top edge 336 (FIG. 3), front side panel top edge 346 (FIG. 3) and rear side panel top edge 356 (FIG. 3) may exhibit congruency within a common plane. The bottom panel second edge 314 (FIG. 3) is adjoined to the front side panel second edge 344 (FIG. 3) and rear side panel second edge 354 (FIG. 3) in a substantially perpendicular manner to form an opening to receive the base tray 100. The second nesting tray 300 may be constructed of wood, metal, plastic or any combination thereof that provide suitable structural properties to accommodate the aforementioned construction and provide the desired rigidity. The method of adjoining each of the aforementioned sides may be by any means know in the Mechanical Arts such as welding, soldering, brazing, the use of fasteners, rivets, screws, nails, or the use of adhesives. The second nesting tray 300 may also be manufactured by such techniques as extrusion, cold forming methods i.e., bending, braking, shearing, cutting or hot forming methods i.e., casting or extrusion or combinations thereof that may yield similar construction. The front side panel 340 and rear side panel 350 of the second nesting tray 300 of the present invention may respectively have at least one front side panel protuberance 374 (FIG. 3) and rear side panel protuberance 376 (FIG. 3), each being attached to a protuberance support 378 (FIG. 3) which extends from the front side panel top edge 346 (FIG. 3) and rear side panel top edge 356 (FIG. 3) respectively. The front side panel protuberance 374 (FIG. 3) and rear side panel protuberance 376 (FIG. 3) each forming a head at the proximal end of the protuberance support 378 (FIG. 3). The protuberance head being of a given solid shape having substantial dimensional compliance to be securely positioned in the respective base tray 100 front panel recess 170 (FIG. 3) and rear panel recess 172 (FIG. 3). In another embodiment of the second nesting tray 300, the front side panel 340 and rear side panel 350 may respectively have at least one front panel protuberance and rear panel protuberance, that may be arranged in a row on the face of each panel being of a given shape and size to accommodate the respective base tray 100 front side panel recess 170 (FIG. 3) and rear side panel recess 172 (FIG. 3). In another embodiment of the second nesting tray 300, the front side panel 340 and rear side panel 350 may respectively have at least one front side panel recess 370 (FIG. 3) and rear side panel recess 372 (FIG. 3), that may be arranged in a row on the face of each panel being of a given shape and depth to accommodate the respective base tray 100 front side panel protuberance and rear side panel protuberance. Subsequently, the expandable drawer organizer 10 may be set at a predetermined length and accordingly maintained by the locking mechanism 50 (FIG. 4–6). In another embodiment the nesting tray 300, may also have expandable partitions 500 (FIG. 7), fixed length partitions or any combination thereof that may be employed which may utilize a locking mechanism based upon the arrangement of protuberances and recesses similar to the arrangement utilized to secure the base tray 100, first nesting tray 200 and second nesting tray 300 at a predetermined length. The expandable partitions 500 (FIG. 7) may be detachably attached in normal position to the bottom panel 310 and at least one side of the second nesting tray 300 to form compartments of a rectangular nature.

Referring to FIGS. 4, 5 and 6 the present embodiment of a locking mechanism is generally shown at number 50 for a two tray organizer 10. FIGS. 4 and 5 provide an exploded partial view of the locking mechanism 50 respectively in a disengaged and engaged state, wherein the base tray 100 and the first nesting tray 200 are separated, and the relative orientation of the base tray 100 first side panel 120 and front side panel 140 with respect to the first nesting tray 200 front side panel 240 is provided. The locking mechanism 50 may comprise a base tray 100 having a first set of top rails formed by the front side panel top edge 146 (FIG. 6) and the rear side panel top edge 156 (FIG. 6) that respectively may ride on a first bottom set of rails formed by the front side panel top edge 246 (FIG. 6) and the rear side panel top edge 256 (FIG. 6) of the first nesting tray 200. The first top and bottom set of rails provide a means for slidably conveying the base tray 100 within the first nesting tray 200 while providing simultaneous alignment of the respective trays to permit the engagement of the front side panel protuberance 274 and rear side panel protuberance 276 respectively with the front side panel recess 170 and rear side panel recess 172. In the three tray embodiment of the expandable drawer organizer 10 of the present invention, the locking mechanism 50 may comprise a second bottom rail. The top set of rails formed by the front side panel top edge 146 (FIG. 3) and the rear side panel top edge 156 (FIG. 3) that respectively may ride on a second bottom set of rails formed by the front side panel top edge 346 (FIG. 3) and the rear side panel top edge 356 (FIG. 3) of the second nesting tray 300. The first and second sets of top and bottom rails provide a means for slidably conveying the base tray 100 within the first nesting tray 200 and second nesting tray 300 (FIG. 3) while simultaneously providing alignment of the respective trays to permit the engagement of the front side panel protuberances 274 and 374 rear side panel protuberances 276 and 376 respectively with the front side panel recesses 170 and rear side panel recesses 172.

The locking mechanism 50 of the present embodiment of the two drawer organizer 10 may comprise a protuberance support 278, which extends from the front side panel top edge 246 and rear side panel top edge 256. The three tray drawer organizer 10 may comprise a protuberance support 378 (FIG. 3), which extends from the front side panel top edge 346 (FIG. 3) and rear side panel top edge 356 (FIG. 3) respectively. The protuberance supports 278 and 378 impart a constant force to the attached protuberance(s) as a function of spring tension, which may be accomplished as a function of bending, pre-forming or the attachment of springs to tensionably accomplish this function. The front side panel protuberance 274 and rear side panel protuberance 276 each forming a head at the proximal end of the protuberance support 278. The protuberance head being of a given solid shape having substantial dimensional compliance to be securely positioned in the respective base tray 100 front side panel recess 170 and rear side panel recess 172. In another embodiment, the locking mechanism 50 may comprise, the front side panel 240 and rear side panel 250 of the first nesting tray 200 respectively having at least one front side panel protuberance and rear side panel protuberance, that may be arranged in a row on the face of each panel. The front and rear side panel protuberance being of a given shape and size to accommodate the respective front side panel recess and rear side panel recess located in base tray 100 front side panel 140 and rear side panel 150. The protuberance may be attached to a spring and retained in an opening, wherein a given portion of the protuberance may project through the opening to engage a corresponding recess.

In another embodiment, the locking mechanism 50 may comprise, the front side panel 240 and rear side panel 250 of first nesting tray 200 respectively having at least one front side panel recess and rear side panel recess, that may be arranged in a row on the face of each panel being of a given shape and depth to accommodate the respective front side panel protuberance and rear side panel protuberance in base tray 100 front side panel 140 and rear side panel 150. The protuberance may be attached to a spring and retained in an opening, wherein a given portion of the protuberance may project through the opening to engage a recess.

Figure 7:
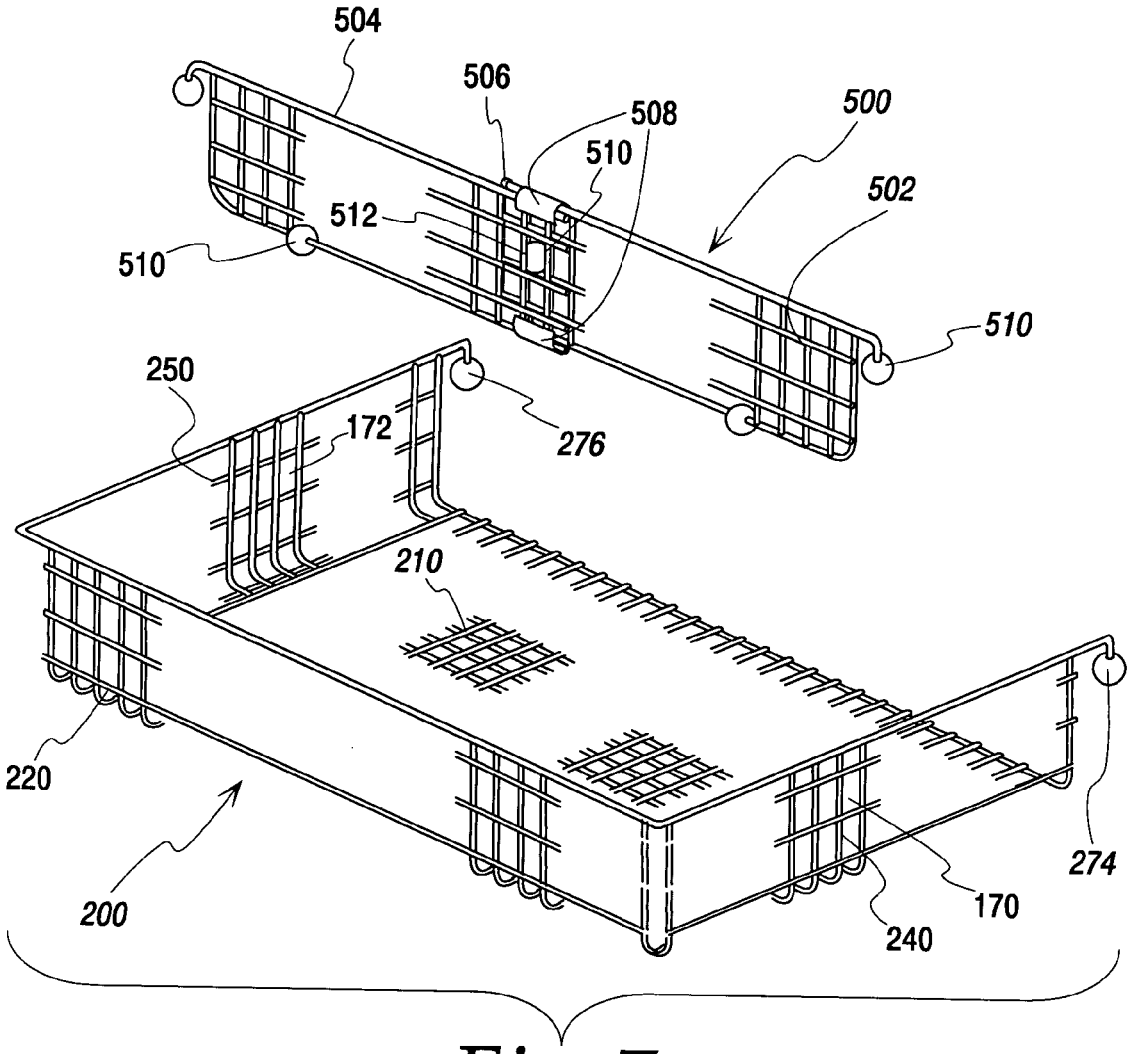
FIG. 7 is a drawing showing a perspective view showing one example of a possible orientation of an adjustable partition and a first nesting tray of the expandable drawer organizer, in accordance with the present invention.

Referring to FIG. 7 the present embodiment of an expandable partition is generally shown at number 500 for an expandable drawer organizer 10. FIG. 7 provides an perspective view of the expandable partition 500 in a disengaged state in respect to the first nesting tray 200 wherein the relative orientation of the expandable partition 500 is substantially parallel to first side panel 220 of the first nesting tray. The expandable partition 500 may be comprised of a first panel 502 and a second panel 504, which may be of similar construction to the first nesting tray 200 (FIG. 3) front side panel 240 (FIG. 3) and rear side panel 250 (FIG. 3); which may be held in slidable communication with at least one panel coupler 508 connected to either of the first panel 502 and second panel 504 top edge, and the first panel 502 and second panel 504 bottom edge. The coupler may comprise any means known in the Mechanical Arts to join panels or similar surfaces when in substantially parallel alignment. The ends of the first panel 502 and second panel 504 edge, and the first panel 502 and second panel 504 bottom edge may have a stop 506, which serves to prevent the accidental separation of the expandable partition 500 by restricting the movement of the panel coupler 508 on the first panel 502 and second panel 504 top edge, and the first panel 502 and second panel 504 bottom edge. The locking mechanism 50 may also be incorporated in the present embodiment of the expandable partition 500 wherein a protuberance 510 located in either of the first panel 502 and second panel 504 engage a corresponding recess 512 in the respective adjoining panel under constant force. Each of the first panel 502 and second panel 504 may also have a protuberance 510 located on the bottom edge, which may engage a corresponding recess in the bottom panel 210. The expandable partition 500 may also incorporate a protuberance 510 attached to projection on the first panel 502 and second panel 504 top edge, that may engage the first nesting tray 200 front panel recess 170 and rear panel recess 172, respectively.

Figure 8:
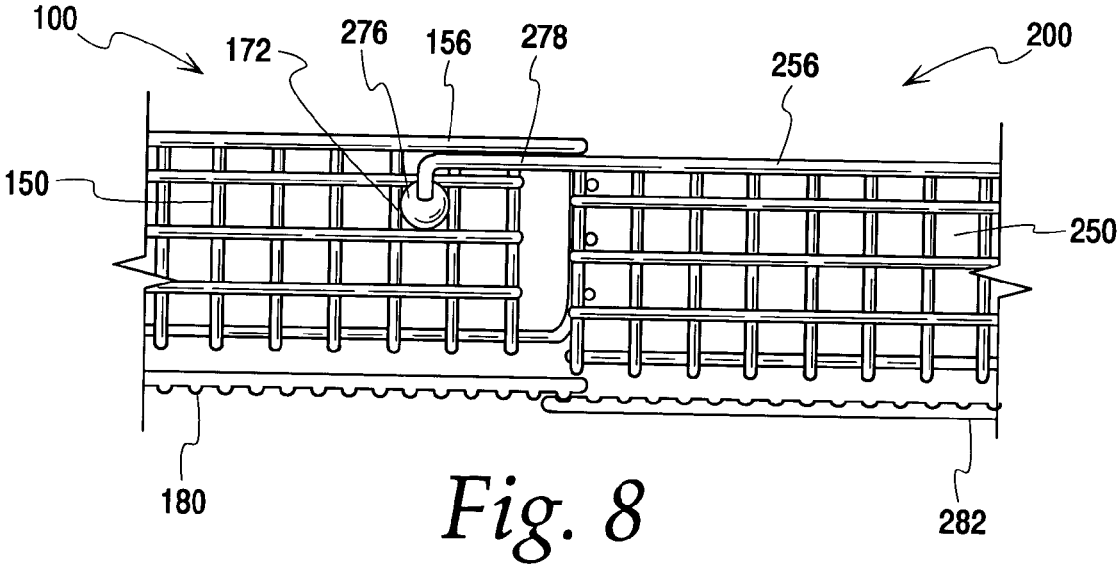
FIG. 8 is a drawing showing a side view of an alternate embodiment of the locking mechanism securing the base tray and first nesting tray of an assembled two tray expandable drawer organizer.
Figure 9:
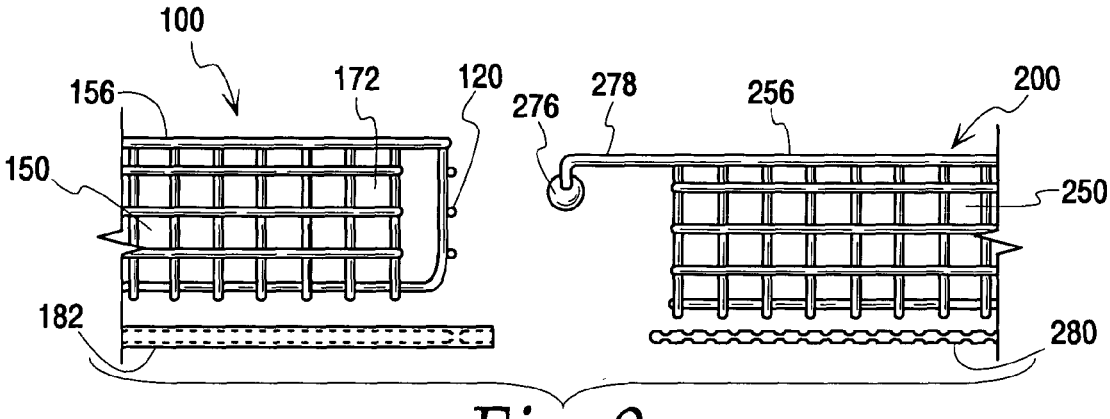
FIG. 9 is a drawing showing a side view of an alternate embodiment of a two tray expandable drawer organizer having an additional locking mechanism securing the base tray and first nesting tray, wherein a tube with a protrusion in the bore, attached to the base tray; is received by a rod with indentations, attached to the first nesting tray.
Figure 10:
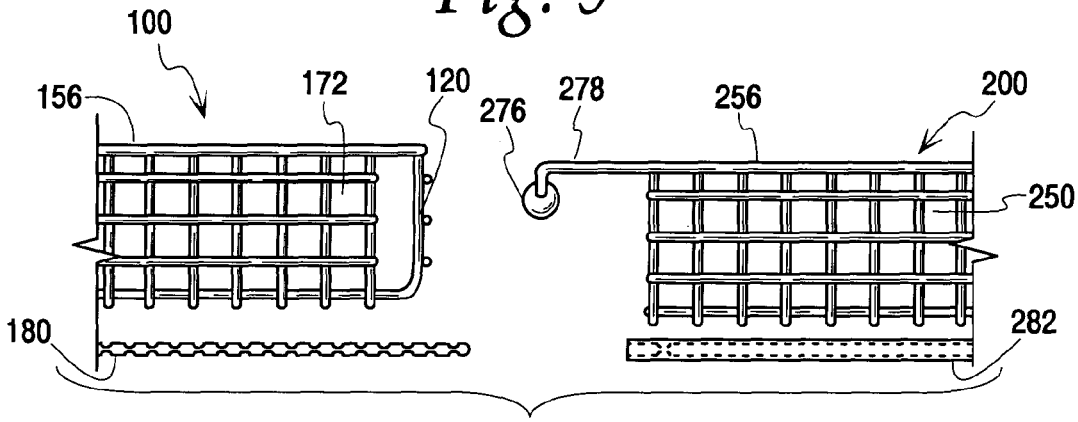
FIG. 10 is a drawing showing a side view of an alternate embodiment of a two tray expandable drawer organizer having an additional locking mechanism securing the base tray and first nesting tray, wherein a rod with indentations attached to the base tray; is received by a tube with a protrusion in the bore, attached to the first nesting tray.

Referring to FIGS. 8, 9 and 10 an alternate embodiment of a locking mechanism is generally shown at numbers 180, 182, 280 and 282 for a two tray organizer 10. FIGS. 8, 9 and 10 provide an exploded partial view of the alternate locking mechanism 180, 182, 280 and 282 wherein the base tray 100 and the first nesting tray 200 are engaged (FIG. 8) and disengaged (FIGS. 9 and 10).

In FIG. 8 one embodiment of the locking mechanism is shown wherein the base tray 100 may have at least one male rod 180 of a given gauge and a given length; not in excess of the bottom panel front edge 116 (FIG. 3), attached to the bottom panel 110 (FIG. 3), in substantially parallel alignment to the bottom panel front edge 116 (FIG. 3) and bottom panel rear edge 118 (FIG. 3), the rod having a series of protrusions about the bottom surface The first nesting tray 200 may have at least one female rod 282, of a given gauge and length; having at least one indentation along the length of the topmost surface; not in excess of the front side panel bottom edge 248 (FIG. 3); attached to the bottom panel 210 (FIG. 3) in substantially parallel alignment to the front side panel bottom edge 248 (FIG. 3) and rear panel bottom edge 258 (FIG. 3), whereby the base tray 100 and male rod 180 are slidably engaged by said first nesting tray 200 and female rod 282, wherein the male rod 180 protrusion may be received by at least one indentation on the surface of the female rod 282, thereby maintaining the relative position of the base tray 100 and first nesting tray 200.

In FIG. 9 one embodiment of the locking mechanism is shown wherein the base tray 100 may have at least one tube 182 of a given gauge and a given length; not in excess of the bottom panel front edge 116 (FIG. 3) attached to the bottom panel 110 (FIG. 3), in substantially parallel alignment to the bottom panel front edge 116 (FIG. 3) and bottom panel rear edge 118 (FIG. 3), the tube 182 having at least one protrusion within the bore. The first nesting tray 200 may have at least one rod 280 having a series of indentations, of a given gauge and length; not in excess of the front side panel bottom edge 248 (FIG. 3); attached to the bottom panel 210 (FIG. 3) in substantially parallel alignment to the front side panel bottom edge 248 (FIG. 3) and rear side panel bottom edge 258 (FIG. 3), that is received by tube 182, whereby the base tray 100 and tube 182 are slidably engaged by said first nesting tray 200 and rod 280, wherein at least one of the indentations may be engaged by the protrusion within the bore of tube 182, thereby maintaining the relative position of the base tray 100 and first nesting tray 200

In FIG. 10 one embodiment of the locking mechanism is shown wherein the base tray 100 may have at least one rod 180 of a given gauge and a given length; not in excess of the bottom panel front edge 116 (FIG. 3), attached to the bottom panel 110 (FIG. 3), in substantially parallel alignment to the bottom panel front edge 116 (FIG. 3) and bottom panel rear edge 118 (FIG. 3), the rod 180 having a series of indentations The first nesting tray 200 may have at least one tube 282, of a given gauge having at least one protrusion within the bore and length; not in excess of the front side panel bottom edge 248 (FIG. 3); attached to the bottom panel 210 (FIG. 3) in substantially parallel alignment to the front side panel bottom edge 248 (FIG. 3) and rear panel bottom edge 258 (FIG. 3), whereby the base tray 100 and rod are slidably engaged by said first nesting tray 200 and tube 282, wherein the rod 180 may be received by tube wherein at least one of the indentations may be engaged by the protrusion within the bore of the tube 282, thereby maintaining the relative position of the base tray 100 and first nesting tray 200.

Figure 11:
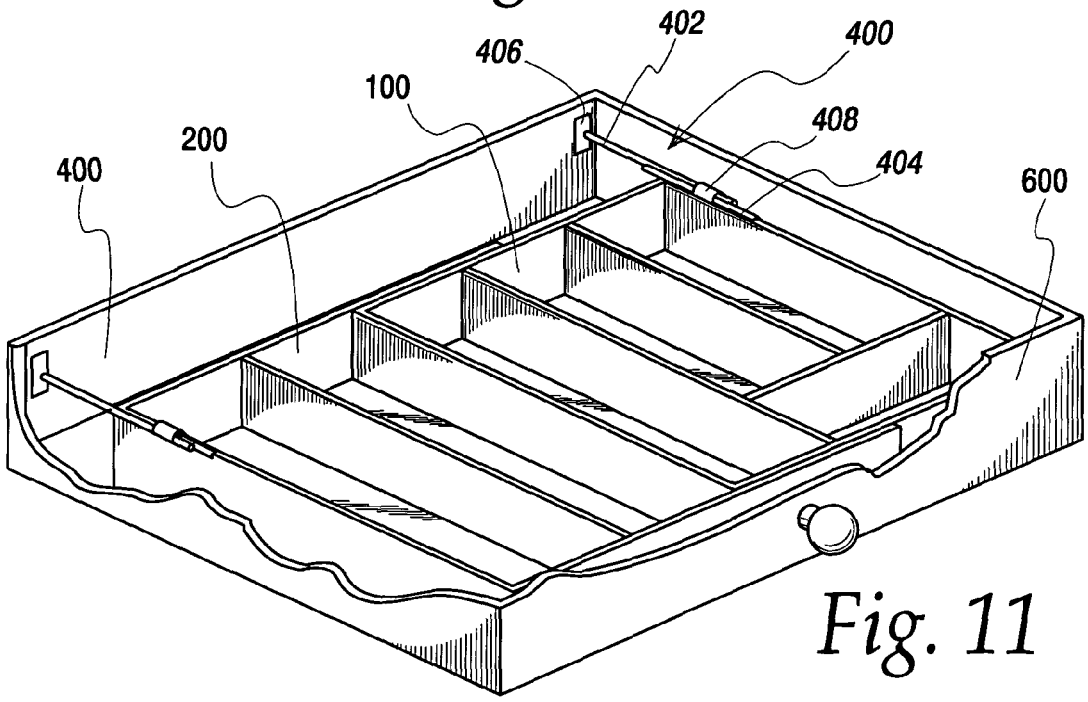
FIG. 11 is a drawing showing a perspective view of another embodiment of an assembled two tray expandable drawer organizer, secured with extendable retainers in a drawer.

Referring to FIG. 11 an extendable retainer mechanism is generally shown at number 400 for a three tray expandable organizer 10. FIG. 11 provides a perspective view of the three tray expandable organizer 10 with the extendable retainer mechanism 400 in place in a cutaway view of drawer 600. The extendable retainer mechanism 400 may comprise an extension arm 402 in slidable agreement with a friction stop/sleeve 404, which may be detachably connected to the rearmost proximity of the base tray 100 second side panel top edge 136 (FIG. 3) and the first nesting tray 200 first side panel top edge 226 (FIG. 3) by an extension arm connector 408 that clips over the respective panel edge. The extension arm 402 may have a given length and profile to provide for a channel to be formed about the longitudinal axis that permits the friction stop/sleeve 404 to ride therein. This channel may be tapered or reticulated to inhibit the movement of the friction stop/sleeve 404 about the channel length. The friction stop/sleeve 404 may be of a given length and of an opposing profile to the extension arm 402, such that the friction stop/sleeve 404 provides nominal alignment and moderate degree of friction, which is amplified upon assembly with the extension arm connector. This provides for the user to adjust the extendable retainer mechanism to achieve adequate tautness of the expandable organizer 10. The extension arm 402 and friction stop/sleeve 404 may be formed from wood, ferrous or non-ferrous materials adequate to provide substantial rigidity and required structural properties. The extension arm connector 408 may be shaped to tensionably retain an extension arm 402 in slidable communication with the friction stop/sleeve 404 thereby preventing the extension arm 402 from collapsing under load after being set to a predetermined length. The extension arm 402 may be fitted with a foot 406 at the distal end of the extension arm 402, wherein contact with the drawer 600 surface is maintained. The foot 402 may further comprise a flexible pad, to prevent marring or scratching the interior drawer 600 surface. The extendable retainer mechanism 400 serves to prevent the expandable drawer organizer 10 from shifting within a drawer 600 when subjected to impulse forces. In another embodiment the extendable retainer mechanism 400 may be configured from an expandable partition 500 (FIG. 7) designed to be attached to the base tray 100 second side panel top edge 136 (FIG. 3) and the first nesting tray 200 first side panel top edge 226 (FIG. 3) by an extension arm connector 408 that clips over the respective panel edge. Subsequently, this embodiment provides for the use of expandable partitions with the extendable retainer, thereby allowing the organization of the drawer to be optimized.

While the embodiments of the present invention disclosed herein are presently considered to be preferred, various changes and modifications can be made without departing from the spirit and scope of the present invention. The scope of the present invention is indicated in the appended claims, and all changes that come within the meaning and range of equivalents are intended to be embraced therein.

What is claimed is:

1. An expandable drawer organizer for segregating articles within a drawer comprising:

a base tray having a bottom panel, a front side panel, a rear side panel, a first side panel and a second side panel wherein, the front side panel, rear side panel, first side panel and second side panel are affixed to the respective edges of the bottom panel in a substantially perpendicular fashion, wherein the front side panel and rear side panel are in substantially parallel alignment and adjoined to the first side panel and second side panel in a substantially perpendicular manner, the first side panel and second side panel which are in substantially parallel alignment, a first nesting tray having a bottom panel having a length and width slightly greater than the base tray, that will permit the base tray to be slidably received in spaced relationship, a front side panel, a rear side panel, and a fist side panel wherein, the front side panel, rear side panel, and first side panel are affixed to the respective edges of the bottom panel in a substantially perpendicular fashion, wherein the front side panel and rear side panel are in substantially parallel alignment and adjoined to the first side panel in a substantially perpendicular manner, wherein the base tray is received by the first nesting tray, a locking mechanism incorporated into the base tray and first nesting tray for securing the base tray and nesting tray wherein the base tray and first nesting tray are maintained in a predetermined position, said base tray has at least one protuberance on at least one of either the front side panel and rear side panel, and said first nesting tray has at least one recess in one of either the front side panel and rear side panel, to engage the protuberance in the corresponding panel of said base tray under a generally constant force, and on each of the front side panel and rear side panel of said first nesting tray has at least one recess in each of the front side panel and rear side panel, that engage the protuberance in the corresponding panel of said base tray under a generally constant force, and at least one partition affixed to one of either of the front side panel, rear side panel, first side panel and second side panel of the base tray in substantially perpendicular alignment to the adjoining side panel and the bottom panel, for segregating articles within the base tray.

2. An expandable drawer organizer for segregating articles within a drawer comprising:

a base tray having a bottom panel, a front side panel, a rear side panel, a first side panel and a second side panel wherein, the front side panel, rear side panel, first side panel and second side panel are affixed to the respective edges of the bottom panel in a substantially perpendicular fashion, wherein the front side panel and rear side panel are in substantially parallel alignment and adjoined to the first side panel and second side panel in a substantially perpendicular manner, the first side panel and second side panel which are in substantially parallel alignment, a first nesting tray having a bottom panel having a length and width slightly greater than the base tray, that will permit the base tray to be slidably received in spaced relationship, a front side panel, a rear side panel, and a first side panel wherein, the front side panel, rear side panel, and first side panel are affixed to the respective edges of the bottom panel in a substantially perpendicular fashion, wherein the front side panel and rear side panel are in substantially parallel alignment and adjoined to the first side panel in a substantially perpendicular manner, wherein the base tray is received by the first nesting tray, a locking mechanism incorporated into the base tray and first nesting tray for securing the base tray and nesting tray wherein the base tray and first nesting tray are maintained in a predetermined position, at least one partition expandably and detachably connected to one of either said base tray and first nesting tray, further comprising;

a first panel of a given height and length with a row having at least one recess, and a row having at least one protuberance, a second panel of a given height and length with a row having at least one recess, and a row having at least one protuberance, wherein the rows alternately correspond to engage under a generally constant force with the first panel, to permit the predetermined expanded length to be maintained, at least one coupler attached to the lengthwise edge of the first panel and second panel, whereby the first panel and second panel are maintained slidably in substantial parallelism, at least one protuberance on each of the first panel and second panel located on the bottom side edge, wherein said partition is expanded to a predetermined length and the protuberance on each of the bottom side edge of the first panel and second panel engage a corresponding recess from a group consisting of: said base tray bottom panel and first nesting tray bottom panel, and at least one protuberance on each of the first panel and second panel located at far extents of said partition on the heightwise edge, wherein said partition is expanded to a predetermined length and the protuberance on each of the heightwise edge of the first panel and second panel engage a corresponding recess under a generally constant force from a group consisting of: said base tray front side panel and rear side panel, first nesting tray front side panel and rear side panel, said base tray first and second side panel, said base tray first side panel and said first nesting tray first side panel, said base tray front side panel and normal another of said expandable partitions, said base tray rear side panel and normal another of said expandable partitions, said base tray first side panel and normal another of said expandable partitions, said base tray second side panel and normal another of said expandable partitions, said first nesting tray front side panel and normal another of said expandable partitions, said first nesting tray rear side panel and normal another of said expandable partitions, said first nesting tray first side panel and normal another of said expandable partitions, and two another of said expandable partitions in substantial parallel alignment.

3. The expandable drawer organizer of claim 2 wherein the expandable partion further comprising a hook attached to the topmost opposing corner of heightwise edge of each of the first panel and second panel, that secure said expandable partition to a normal surface.

4. The expandable drawer organizer of claim 3 wherein said hook of the expandable partition terminates in a head that engages a recall adjacent to the recess engaged by the protuberance on each of the heightwise edge of the first panel and second panel, the corresponding recess from a group consisting of: said base tray front side panel and rear side panel, first nesting tray front side panel and rear side panel, said base tray first and second side panel, said base tray first side panel and said first nesting tray first side panel, said base tray front side panel and normal another of said expandable partitions said base tray rear side panel and normal another of said expandable partitions, said base tray first side panel and normal another of said expandable partitions, said base tray second side panel and normal another of said expandable partitions, said first nesting tray front side panel and normal another of said expandable partitions, said first nesting tray rear side panel and normal another of said expandable partitions, said first side panel and normal another of said expandable partitions, and two another of said expandable partitions in substantial parallel alignment.

5. An expandable drawer organizer for segregating articles within a drawer comprising:

a base tray having a bottom panel, a front side panel, a rear side panel, a first side panel and a second side panel wherein, the front side panel, rear side panel, first side panel and second side panel are affixed to the respective edges of the bottom panel in a substantially perpendicular fashion, wherein the front side panel and rear side panel are in substantially parallel alignment and adjoined to the first side panel and second side panel in a substantially perpendicular manner, the first side panel and second side panel which are in substantially parallel alignment, a first nesting tray having a bottom panel having a length and width slightly greater than the base tray, that will permit the base tray to be slidably received in spaced relationship, a front side panel, a rear side panel and a first side panel wherein, the front side panel, rear side panel, and first side panel are affixed to the respective edges of the bottom panel in a substantially perpendicular fashion, wherein the front side panel and rear side panel are in substantially parallel alignment and adjoined to the first side panel in a substantially perpendicular manner, wherein the base tray is received by the first nesting tray, a locking mechanism incorporated into the base tray and first nesting tray for securing the base tray and nesting tray wherein the base tray and first nesting tray are maintained in a predetermined position, at least one partition detachably connected to one of either said base tray and first nesting tray, further comprising;

a first panel of a given height and length, having at least one protuberance located on the front and rear side, wherein the protuberances alternately correspond to engage a recess under a generally constant force within a row located from a group consisting of: said base tray front side panel and rear side panel, first nesting tray front side panel and rear side panel, said base tray first and second side panel, said base tray first side panel and said first nesting tray first side panel, said base tray front side panel and normal another of said expandable partitions said base tray rear side panel and normal another of said expandable partitions, said base tray first side panel and normal another of said expandable partitions said base tray second side panel and normal another of said expandable partitions, said first nesting tray front side panel and normal another of said expandable partitions said first nesting tray rear side panel and normal another of said expandable partitions said first nesting tray first side panel and normal another of said expandable partitions, and two another of said partitions in substantial parallel alignment.

6. An expandable drawer organizer for segregating articles within a drawer comprising:

a base tray having a bottom panel, a front side panel, a rear side panel, a first side panel and a second side panel wherein, the front side panel, rear side panel, first side panel and second side panel are affixed to the respective edges of the bottom panel in a substantially perpendicular fashion, wherein the front side panel and rear side panel are in substantially parallel alignment and adjoined to the first side panel and second side panel in a substantially perpendicular manner, the first side panel and second side panel which are in substantially parallel alignment; a first nesting tray having a bottom panel having a length and width slightly greater than the base tray, that will permit the base tray to be slidably received in spaced relationship, a front side panel, a rear side panel, and a first side panel wherein, the front side panel, rear side panel, and first side panel are affixed to the respective edges of the bottom panel in a substantially perpendicular fashion, wherein the front side panel and rear side panel are in substantially parallel alignment and adjoined to the first side panel in a substantially perpendicular manner, wherein the base tray is received by the first nesting tray, wherein: said base tray has at least one tube of a given gauge and a given length; not in excess of the bottom panel front edge width, attached to the bottom panel, in substantially parallel alignment to the bottom panel front and rear edge, said tube defining a bore and having at least one protrusion within the bore; and said first nesting tray has at least one rod having a series of indentations, of a given gauge and length; not in excess of the first nesting tray bottom panel front edge width; attached to the bottom panel in substantially parallel alignment to the bottom panel front and rear edge, in proximity of the first nesting tray first side panel bottom edge, that is received by said tube, whereby said base tray and tube are slidably engaged by said first nesting tray and rod, wherein at least one of the indentations is engaged by the protrusion within said bore, thereby maintaining the relative position of said base tray and first nesting tray, a locking mechanism incorporated into the base tray and first nesting tray for securing the base tray and nesting tray wherein the base tray and first nesting tray are maintained in a predetermined position, and at least one partition affixed to one of either of the front side panel, rear side panel, first side panel and second side panel of the base tray in substantially perpendicular alignment to the adjoining side panel and the bottom panel, for segregating articles within the base tray.

7. An expandable drawer organizer for segregating articles within a drawer comprising:

a base tray having a bottom panel, a front side panel, a rear side panel, a first side panel and a second side panel wherein, the front side panel, rear side panel, first side panel and second side panel are affixed to the respective edges of the bottom panel in a substantially perpendicular fashion, wherein the front side panel and rear side panel are in substantially parallel alignment and adjoined to the first side panel and second side panel in a substantially perpendicular manner, the first side panel and second side panel which are in substantially parallel alignment, a first nesting tray having a bottom panel having a length and width slightly greater than the base tray, that will permit the base tray to be slidably received in spaced relationship, a front side panel, a rear side panel, and a first side panel wherein, the front side panel, rear side panel, and first side panel are affixed to the respective edges of the bottom panel in a substantially perpendicular fashion, wherein the front side panel and rear side panel are in substantially parallel alignment and adjoined to the first side panel in a substantially perpendicular manner, wherein the base tray is received by the first nesting tray, said first nesting tray has at least one tube, of a given gauge and length; not in excess of the first nesting tray bottom panel front edge width; attached to the bottom panel in substantially parallel alignment to the bottom panel front and rear edge, in proximity of the first nesting tray first side panel bottom, said tube defining a bore and having at least one protrusion within the bore;

said base tray has at least one rod having a series of indentations of a given gauge and a given length; not in excess of the bottom panel front edge width, attached to the bottom panel, in substantially parallel alignment to the bottom panel front and rear edge, that is received by said tube; whereby said base tray and tube are slidably engaged by said first nesting tray and rod, wherein at least one of the indentations is engaged by the protrusion within said bore, thereby maintaining the relative position of said base tray and first nesting tray, a locking mechanism incorporated into the base tray and first nesting tray for securing the base tray and nesting tray wherein the base tray and first nesting tray are maintained in a predetermined position, and at least one partition affixed to one of either of the front side panel, rear side panel, first side panel and second side panel of the base tray in substantially perpendicular alignment to the adjoining side panel and the bottom panel, for segregating articles within the base tray.

8. An expandable drawer organizer for segregating articles within a drawer comprising:

a base tray having a bottom panel, a front side panel, a rear side panel, a first side panel and a second side panel wherein, the front side panel, rear side panel, first side panel and second side panel are affixed to the respective edges of the bottom panel in a substantially perpendicular fashion, wherein the front side panel and rear side panel are in substantially parallel alignment and adjoined to the first side panel and second side panel in a substantially perpendicular manner, the first side panel and second side panel which are in substantially parallel alignment, wherein, said base tray has at least one recess in at least one of either the front side panel and rear side panel, a first nesting tray having a bottom panel having a given length comprising a range slightly greater than the length of the base tray to slightly less than half of the base tray length, and width slightly greater than the base tray, that will permit the base tray to be slidably received in spaced relationship, a front side panel, a rear side panel, and a first side panel wherein, the front side panel, rear side panel, and first side panel are affixed to the respective edges of the bottom panel in a substantially perpendicular fashion, wherein the front side panel and rear side panel are in substantially parallel alignment and adjoined to the first side panel in a substantially perpendicular manner, wherein the base tray is received by the first nesting tray, a second nesting tray having a bottom panel having a given length and width slightly larger than the base tray and slightly less than the given length of the first nesting tray, that will permit the base tray to be slidably received in spaced relationship, a front side panel, a rear side panel, and a first side panel wherein, the front side panel, rear side panel, and first side panel are affixed to the respective edges of the bottom panel in a substantially perpendicular fashion, wherein the front side panel and rear side panel are in substantially parallel alignment and adjoined to the first side panel in a substantially perpendicular manner, wherein the base tray is received by the second nesting tray, a locking mechanism incorporated into the base tray, first and second nesting tray for securing the base tray, first and second nesting tray wherein the base tray, first and second nesting tray are maintained in a predetermined position, said first and second nesting tray have at least one protuberance on one of either the front side, panel and rear side panel, that engage the recess in the corresponding panel of said base tray under a generally constant force and each of the front side panel and rear side panel of said first and second nesting tray have at least one protuberance on each of the front side panel and rear side panel, that engage the recess in the corresponding panel of said base tray under a generally constant force, and at least one partition affixed to one of either said base tray, first and second nesting tray for segregating articles within the base tray.

9. An expandable drawer organizer for segregating articles within a drawer comprising:

a base tray having a bottom panel, a front side panel, a rear side panel, a first side panel and a second side panel wherein, the front side panel, rear side panel, first side panel and second side panel are affixed to the respective edges of the bottom panel in a substantially perpendicular fashion, wherein the front side panel and rear side panel are in substantially parallel alignment and adjoined to the first side panel and second side panel in a substantially perpendicular manner, the first side panel and second side panel which are in substantially parallel alignment, a first nesting tray having a bottom panel having a given length comprising a range slightly greater than the length of the base tray to slightly less than half of the base tray length, and width slightly greater than the base tray, that will permit the base tray to be slidably received in spaced relationship, a front side panel, a rear side panel, and a first side panel wherein, the front side panel, rear side panel, and first side panel are affixed to the respective edges of the bottom panel in a substantially perpendicular fashion, wherein the front side panel and rear side panel are in substantially parallel alignment and adjoined to the first side panel in a substantially perpendicular manner, wherein the base tray is received by the first nesting tray, a second nesting tray having a bottom panel having a given length and width slightly larger than the base tray and slightly less than the given length of the first nesting tray, that will permit the base tray to be slidably received in spaced relationship, a front side panel, a rear side panel, and a first side panel wherein, the front side panel, rear side panel, and first side panel are affixed to the respective edges of the bottom panel in a substantially perpendicular fashion, wherein the front side panel and rear side panel are in substantially parallel alignment and adjoined to the first side panel in a substantially perpendicular manner, wherein the base tray is received by the second nesting tray, a locking mechanism incorporated into the base tray, first and second nesting tray for securing the base tray, first and second nesting tray wherein the base tray, first and second nesting tray are maintained in a predetermined position, wherein, said base tray has at least one protuberance on at least one of either the front side panel and rear side panel, and said first and second nesting tray have at least one recess in one of either the front side panel and rear side panel, that engage the protuberance in the corresponding panel of said base tray under a generally constant force and each of the front side panel and rear side panel of said first and second nesting tray have at least one recess in each of the front side panel and rear side panel, that engage the protuberance in the corresponding panel of said base tray under a generally constant force, and at least one partition affixed to one of either said base tray, first nesting tray and second nesting tray for segregating articles within the base tray.

10. The expandable drawer organizer of claim 9 wherein said partition is expandable and detachably connected to one of either said base tray, first nesting tray and second nesting tray, further comprising;

a first panel of a given height and length with a row having at least one recess, and a row having at least one protuberance, a second panel of a given height and length with a row having at least one recess, and a row having at least one protuberance, wherein the rows alternately correspond to engage with the first panel under a generally constant force, to permit the predetermined expanded length to be maintained, at least one coupler attached to the lengthwise edge of to first panel and second panel, whereby the first panel and second panel are maintained slidably in substantial parallelism, at least one protuberance on each of the first panel and second panel located on the bottom side edge, wherein said partition is expanded to a predetermined length and the protuberance on each of the bottom side edge of the first panel and second panel engage a corresponding recess from a group consisting of: said base tray bottom panel, first nesting tray bottom panel and second nesting tray bottom panel at least one protuberance on each of the first panel and second panel located at the far extents of said partition on the heightwise edge, at least one protuberance associated with the heightwise edge, wherein said partition is expanded to a predetermined length and the protuberance on each of the heightwise edge of the first panel and second panel engage a corresponding recess under a generally constant force from a group consisting of: said base tray front side panel and rear side panel, first nesting tray front side panel and rear side panel, second nesting tray front side panel and rear side panel, said base tray first and second side panel, said base tray first side panel and said first nesting tray first side panel, said base tray first side panel and said second nesting tray first side panel, said base tray front side panel and normal another of said expandable partitions said base tray rear side panel and normal another of said expandable partitions said base tray first side panel and normal another of said expandable partitions, said base tray second side panel and normal another of said expandable partitions said first nesting tray front side panel and normal said expandable partitions said second nesting tray front side panel and normal another of said expandable partitions, said first nesting tray rear side panel and normal another of said expandable partitions, said second nesting tray rear side panel and normal another of said expandable partitions said first nesting tray first side panel and normal another of said expandable partitions said second nesting tray first side panel and normal another of said expandable partitions, and two another of said expandable partitions in substantial parallel alignment.

11. The expandable drawer organizer of claim 10, the expandable partition further comprising a hook attached to the topmost opposing corner of the heightwise edge of each of the first panel and second panel, that secure said expandable partition to a normal surface.

12. The expandable drawer organizer of claim 11 wherein said hook terminates in a head that engages a recess adjacent to the recess engaged by the protuberance on each of the heightwise edge of the first panel and second panel, the corresponding recess from a group consisting of: said base tray front side panel and rear side panel, first nesting tray front side panel and rear side panel, second nesting tray front side panel and rear side panel, said base tray first and second side panel, said base tray first side panel and said first nesting tray first side panel, said base tray first side panel and said second nesting tray first side panel, said base tray front side panel and normal another of said expandable partitions said base tray rear side panel and normal another of said expandable partitions, said base tray first side panel and normal another of said expandable partitions, said base tray second side panel and normal another of said expandable partitions, said first nesting tray front side panel and normal another of said expandable partitions, said second nesting tray front side panel and normal another of said expandable partitions, said first nesting tray rear side panel and normal another of said expandable partitions, said second nesting tray rear side panel and normal another of said expandable partitions, said first nesting tray first side panel and normal another of said expandable partitions, said second nesting tray first side panel and normal another of said expandable partitions, and two another of said expandable partitions in substantial parallel alignment.

13. The expandable drawer organizer of claim 9 wherein said partition is detachably connected to at least one of said base tray, and first nesting tray, and said second nesting tray further comprising;

a first panel of a given height and length, having at least one protuberance located on the front and rear side, wherein the protuberances alternately correspond to engage a recess under a generally constant force within a row located from a group consisting of: said base tray front side panel and rear side panel, first nesting tray front side panel and rear side panel, second nesting tray front side panel and rear side panel, said base tray first and second side panel, said base tray first side panel and said first nesting tray first side panel, said base tray first side panel and said second nesting tray first side panel, said base tray front side panel and normal another of said expandable partitions, said base tray rear side panel and normal another said partitions said base tray first side panel and normal another of said expandable partitions, said base tray second side panel and normal another of said expandable partitions said first nesting tray front side panel and normal said expandable partition, said second nesting tray front side panel and normal said expandable partitions said first nesting tray rear side panel and normal another of said expandable partitions, said second nesting tray rear side panel and normal another of said expandable partition, said first nesting tray first side panel and normal another of said expandable partition, said second nesting tray first side panel and normal another of said expandable partition, and two another of said partitions in substantial parallel alignment.

14. An expandable drawer organizer for segregating articles within a drawer comprising:

a base tray having a bottom panel, a front side panel, a rear side panel, a first side panel and a second side panel wherein, the front side panel, rear side panel, first side panel and second side panel are affixed to the respective edges of the bottom panel in a substantially perpendicular fashion, wherein the front side panel and rear side panel are in substantially parallel alignment and adjoined to the first side panel and second side panel in a substantially perpendicular manner, the first side panel and second side panel which are in substantially parallel alignment, a first nesting tray having a bottom panel having a given length comprising a range slightly greater tan the length of the base tray to slightly less than half of the base tray length, and width slightly greater than the base tray, that will permit the base tray to be slidablv received in spaced relationship, a front side panel, a rear side panel, and a first side panel wherein, the front side panel, rear side panel, and first side panel are affixed to the respective edges of the bottom panel in a substantially perpendicular fashion, wherein the front side panel and rear side panel are in substantially parallel alignment and adjoined to the first side panel in a substantially perpendicular manner, wherein the base tray is received by the first nesting tray, a second nesting tray having a bottom panel having a given length and width slightly larger than the base tray and slightly less than the given length of the first nesting tray, that will permit the base tray to be slidably received in spaced relationship, a front side panel, a rear side panel, and a first side panel wherein, the front side panel, rear side panel, and first side panel are affixed to the respective edges of the bottom panel in a substantially perpendicular fashion, wherein the front side panel and rear side panel are in substantially parallel alignment and adjoined to the first side panel in a substantially perpendicular manner, wherein the base tray is received by the second nesting tray, said base tray has at least one tube of a given gauge and a given length; not in excess of the bottom panel front edge width, attached to the bottom panel, in substantially parallel alignment to the bottom panel front and rear edge, said tube defining a bore and having at least two protrusions; each located at opposite ends within the bore;

said first nesting tray has at least one rod having a series of indentations, of a given gauge and length; not in excess of the first nesting tray bottom panel front edge width; attached to the bottom panel in substantially parallel alignment to the front and rear edge, in proximity of the first nesting tray first side panel bottom edge, that is received by said tube, whereby said base tray and tube are slidably engaged by said first nesting tray and rod, wherein at least one of the indentations is engaged by the protrusion within said bore, thereby maintaining the relative position of said base tray and first nesting tray, said second nesting tray has at least one rod having a series of indentations, of a given gauge and length; not in excess of the second nesting tray bottom panel front edge width; attached to the bottom panel in substantially parallel alignment to the front and rear edge, in proximity of the second nesting tray first side panel bottom edge, that is received by said tube, whereby said base tray and tube are slidably engaged by said second nesting tray and rod, wherein at least one of the indentations is engaged by the protrusion within said bore, thereby maintaining the relative position of said base tray and second nesting tray, a locking mechanism incorporated into the base tray, first and second nesting tray for securing the base tray, first and second nesting tray wherein the base tray, first and second nesting tray are maintained in a predetermined position, and at least one partition affixed to one of either said base tray, first and second nesting tray for segregating articles within the base tray.

15. An expandable drawer organizer for segregating articles within a drawer comprising:

a base tray having a bottom panel, a front side panel a rear side panel, a first side panel and a second side panel wherein, the front side panel rear side panel, first side panel and second side panel are affixed to the respective edges of the bottom panel in a substantially perpendicular fashion, wherein the front side panel and rear side panel are in substantially parallel alignment and adjoined to the first side panel and second side panel in a substantially perpendicular manner, the first side panel and second side panel which are in substantially parallel alignment, a first nesting tray having a bottom panel having a given length comprising a range slightly greater than the length of the base tray to slightly less than half of the base tray length, and width slightly greater than the base tray, that will permit the base tray to be slidablv received in spaced relationship, a front side panel, a rear side panel, and a first side panel wherein, the front side panel, rear side panel, and first side panel are affixed to the respective edges of the bottom panel in a substantially perpendicular fashion, wherein the front side panel and rear side panel are in substantially parallel alignment and adjoined to the first side panel in a substantially perpendicular manner, wherein the base tray is received by the first nesting tray, a second nesting tray having a bottom panel having a given length and width slightly larger than the base tray and slightly less than the given length of the first nesting tray, that will permit the base tray to be slidably received in spaced relationship, a front side panel, a rear side panel, and a first side panel wherein, the front side panel rear side panel, and first side panel are affixed to the respective edges of the bottom panel in a substantially perpendicular fashion, wherein the front side panel and rear side panel are in substantially parallel alignment and adjoined to the first side panel in a substantially perpendicular manner, wherein the base tray is received by the second nesting tray, said first nesting tray has at least one tube, of a given gauge and length; not in excess of the first nesting tray bottom panel front edge width; attached to the bottom panel in substantially parallel alignment to the front and rear edge, in proximity of the first nesting tray first side panel bottom edge, said tube defining a bore and having at least one protrusion within the bore;

said second nesting tray has at least one tube, of a given gauge and length; not in excess of the second nesting tray bottom panel front edge width; attached to the bottom panel in substantially parallel alignment to the front and rear edge, in proximity of the second nesting tray first side panel bottom edge, said tube having at least two protrusions located at opposite ends within the bore;

said base tray has at least one rod having a series of indentations of a given gauge and a given length; not in excess of the bottom panel front edge width, attached to the bottom panel, in substantially parallel alignment to the bottom panel front and rear edge, that is received by said tube, whereby said base tray and tube are slidably engaged by said first nesting tray and rod, and second nesting tray and rod, wherein at least one of the indentations is engaged by the protrusions within said bore, thereby maintaining the relative position of said base tray and first nesting tray, a locking mechanism incorporated into the base tray, first and second nesting tray for securing the base tray, first and second nesting tray wherein the base tray, first and second nesting tray are maintained in a predetermined position, and at least one partition affixed to one of either said base tray, first and second nesting tray for segregating articles within the base tray.

* * * * *